US006233798B1

(12) United States Patent
Bogucki-Land

(10) Patent No.: US 6,233,798 B1
(45) Date of Patent: May 22, 2001

(54) WARPING MACHINE AND PROCESS FOR PRODUCING PATTERN WARPS

(75) Inventor: Bogdan Bogucki-Land, Offenbach/Main (DE)

(73) Assignee: Karl Mayer Textilmaschinenfabrik GmbH, Obertshausen (DE)

( * ) Notice: Subject to any disclaimer, the term of this patent is extended or adjusted under 35 U.S.C. 154(b) by 0 days.

(21) Appl. No.: 09/407,440

(22) Filed: Sep. 29, 1999

(30) Foreign Application Priority Data

Oct. 1, 1998 (DE) ..... 198 45 245

(51) Int. Cl.[7] ..... D02H 9/02
(52) U.S. Cl. ..... 28/190; 28/195
(58) Field of Search ..... 28/190, 191, 193, 28/195, 196, 192, 194, 184; 139/450, 452, 453

(56) References Cited

U.S. PATENT DOCUMENTS

| | | | | |
|---|---|---|---|---|
| 4,409,710 | * | 10/1983 | Kofler | 28/196 |
| 4,683,625 | * | 8/1987 | Baltzer | 28/191 |
| 4,765,041 | * | 8/1988 | Baltzer | 28/191 |
| 5,022,128 | * | 6/1991 | Beerli et al. | 28/191 |
| 5,590,448 | | 1/1997 | Lenzen et al. | 28/191 |
| 5,950,289 | * | 9/1999 | Tanaka | 28/190 |
| 5,956,827 | * | 9/1999 | Vieri | 28/191 |

FOREIGN PATENT DOCUMENTS

| | | |
|---|---|---|
| 19605924 | 8/1929 | (DE) . |
| 4422098 | 1/1996 | (DE) . |
| 19605924 | 8/1997 | (DE) . |
| 0375480 | 11/1989 | (EP) . |
| 860477 | 3/1996 | (JP) . |

OTHER PUBLICATIONS

Japanese Official Action, dated Mar. 7, 2000.

European Search Report, dated Jan. 11, 2000, EP 99 11 7601.

* cited by examiner

*Primary Examiner*—Amy B. Vanatta
(74) *Attorney, Agent, or Firm*—Omri M. Behr

(57) ABSTRACT

In a procedure for the provision of pattern warps, different threads 12 are pulled off by a rotating thread guide from a circulating thread creel 27 circulating synchronously therewith. The threads are laid off on parallel transport bands oriented axially around the circumference of a non-rotating drum. At predetermined times unneeded threads 12 are connected to the thread guide 11 via a clamp and cut between the clamping point 19 and the drum. Upon renewed demand, the free thread ends 22 are held stationary and the clamp is opened. In a warp knitting machine in which this procedure can be carried out, every thread guide 11 is provided with an orbiting clamping point 19. A cutting arrangement 20 serves for cutting the threads 12 between the clamping point 19 and the drum 1. On the machine frame there is provided a stationary holding arrangement for the free threads ends. In this manner it is possible to create a plurality of different patterns in a relatively short time.

10 Claims, 2 Drawing Sheets

WARPING MACHINE AND PROCESS FOR PRODUCING PATTERN WARPS

BACKGROUND OF THE INVENTION

1. Field of the Invention

The present invention relates to (a) a process for generating pattern warps in which different threads are pulled by a rotating thread guide from a creel rotating synchronously therewith to be laid off on parallel transport bands running axially and distributed circumferentially around a non-rotating drum; as well as (b) a pattern warps warping machine with a non-rotating drum on whose circumference there are provided axially disposed, parallel transport bands with a rotating creel and with rotatable thread guides rotating synchronously therewith in order to pull threads from the rotating creel and lay them onto the thread bands.

2. Description of Related Art

An example of the state of the art is disclosed in German OLS DE 196 05 924 A1. In the known pattern warps warping machine the rotating creel carries eight spools so that eight threads can be simultaneously laid about the drum circumference by means of the appropriate thread guide. This permits one to keep the production time short for the desired pattern warps. However, the patterning possibilities are somewhat restricted because the pattern repeats itself after eight threads.

A virtually unlimited pattern complement, however, can be obtained on a commercially available pattern warps warping machine in which always only one thread from the thread guide is: (a) taken up in a reserve magazine, (b) would around the drum, and (c) when the need lapses, again laid off in the reserve magazine. There follows then the next thread, which is taken out of another reserve magazine, wound around the drum and then again laid off. However, this gives rise to longer production times.

SUMMARY OF THE INVENTION

In accordance with the illustrative embodiments demonstrating features and advantages of the present invention, there is provided a process employing thread guides for producing pattern warps on axially oriented transport bands distributed circumferentially around a non-rotating drum. The pattern warps are made from different threads from a rotatable creel. The process includes the step of pulling from the rotatable creel different threads by rotating the thread guides synchronously with the rotatable creel. Another step is laying different threads about the transport bands on the non-rotating drum. The process also includes the step of connecting threads not needed at a particular time point to their thread guide by clamping and cutting the threads upstream of the drum. Another step is holding stationary and unclamping from the thread guides, a free cut end of thread now needed.

According to another aspect of the invention, a pattern warps warping machine is provided with a non-rotating drum and a parallel plurality of axially oriented, transport bands. These bands are distributed circumferentially around the drum. Also included is a rotating creel and thread guides. The thread guides are synchronously rotatable with the creel for pulling threads therefrom and laying some on the transport bands. The thread guides each have an orbiting clamping means for clamping thread at a clamping point. The clamping means includes cutting means for cutting off threads between the clamping point and the drum. The machine also has a stationary holding means for holding stationary, free thread ends from the thread guides.

Accordingly, an object of the present invention is to provide more pattern opportunities with shorter production times. This task is procedurally solved whereby the threads not needed at a particular time point are connected wit their thread guide by clamping and are cut between the clamping point and the drum. Upon a renewed need, the free thread end of the previously quiescent thread is held stationary and unclamped from the thread guide.

Since the unneeded threads are connected with their thread guide by clamping means and furthermore, cut between the clamping point and the drum, these unneeded threads are carried around during the rotation but are not wound onto the drum. This avoids collisions between the threads currently in use and required by the pattern. Thus, a selection is possible of the threads available from the rotating creel to be wound onto the drum. This enables the creation of patterns in a time shorter than heretofore. When it is desired to again take up threads into the pattern which are now needed, it is merely necessary to hold the free thread end in a stationary manner and to release the clamp.

In a further embodiment, patterning occurs wherein two or more similar threads are laid at the same time, which in a plurality of patterns give rise to a substantial simplification of the work. As a matter of construction, with the assistance of the rotating clamping points, the cutting arrangement and the stationary holding arrangement, the present task is solved by arranging the necessary process steps that are to be carried out. In a further development offering simplifications, the individual cutting points are activated at the same time as the clamping points. There are several possibilities available for the closing and opening of the rotating clamping points. It is particularly desirable to utilize a Maltese cross for opening and closing the clamping points. A stationary switching arrangement completes the required turn of the Maltese cross for activation, based on the run movement.

Alternatively the clamping arrangement may be activated by an orbiting air cylinder or by an orbiting electromagnet wherein the pneumatic or electric signal line may be led over a distribution point on the hub of the thread guide arrangement.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
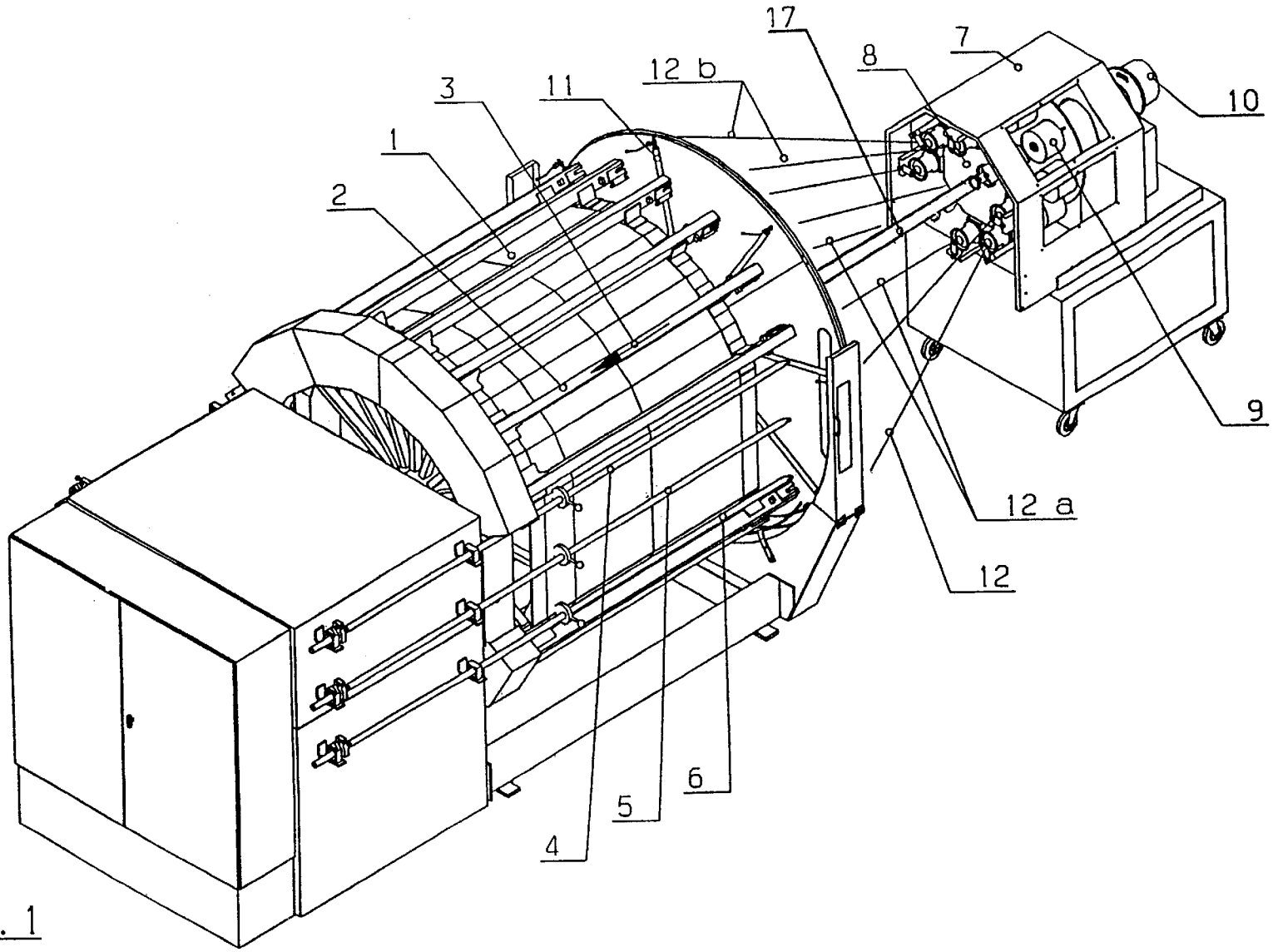
FIG. 1 is a prospective view of a pattern warps warping machine in accordance with principles of the present invention.
Figure 3:
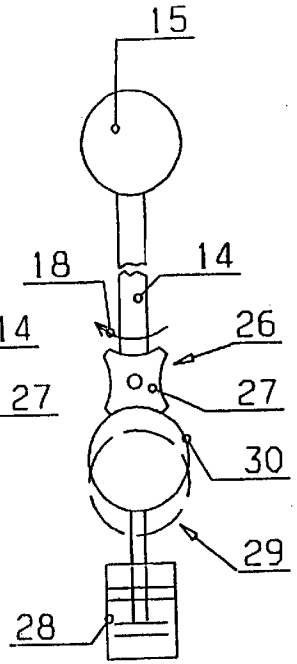
FIG. 3 is a side elevational view of a Maltese cross switching arrangement.
Figure 4:
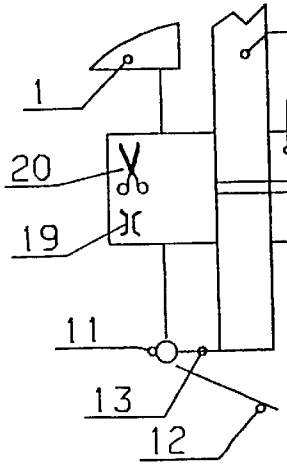
FIG. 4 is an elevational view from the left of FIG. 3.

The pattern warps warping machine of FIG. 1 comprises a drum 1 around the circumference of which, axially directed, parallel transport bands 2 are slowly circulated in the direction of arrow 3. Partial rods 4, 5 and 6 oriented parallel to the drum axis, according to their function, can be designated as crossing or cutting rods.

A rotating creel 7 comprises a rotor 8 which carries a plurality of spools 9 and which is driven by a Karden beam 17. Located at the end of drum 1 are thread guides 11, which are driven synchronously with the rotor 8 part of the rotating creel 7. Thread guides 11 pull threads 12 from the rotating creel 7 and lay them on the transport bands 2 and, by choice, under or over the partial rods 4, 5 and 6. The threads 12 can be different however, selectively taken from a plurality of groups 12A and 12B, which consist, however preferably of two or more similar threads.

In this operation the drum 1 is held in a non-rotating fashion so that there is yielded a thread layer progressing in the direction of arrows 3. In a second working arrangement a plurality of threads are simultaneously pulled from the then rotating drum 1 so that one obtains pattern warps from a larger number of threads.

Figure 2:
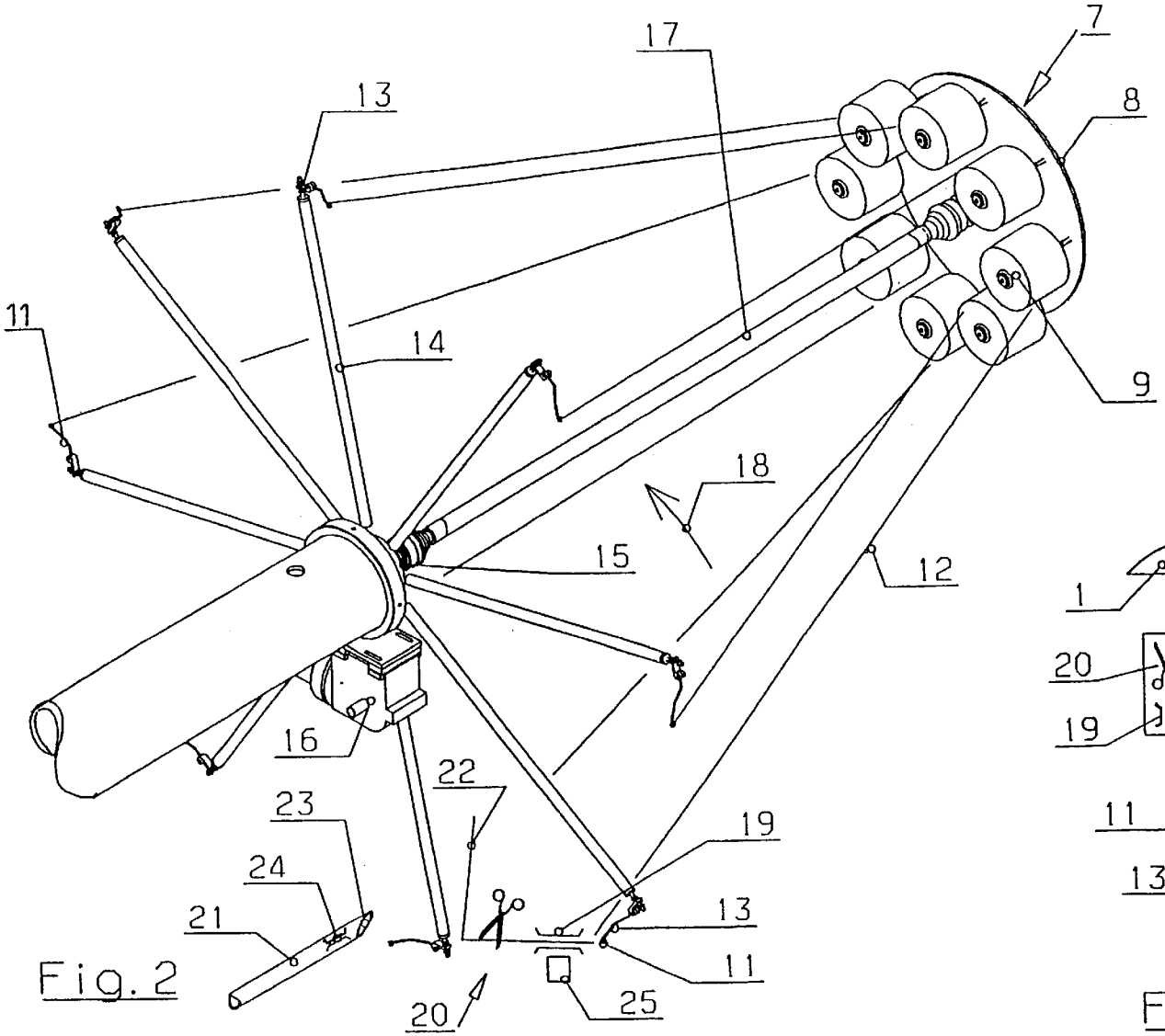
FIG. 2 is a perspective schematic illustration of a rotating creel and rotating thread guides with additional structural parts employed by the machine of FIG. 1.

FIG. 2 shows that the thread guide 11 circles the edge of drum 1 via an arm 13 to which radial spokes 14 are attached. The spokes are held in a hub 15, which is driven by a motor 16 and, without using motor 10 (FIG. 1), carries the rotor 8 of the rotating creel 7 via a Kardan Shaft 17. It is assumed that the described portions rotate in a counter clockwise direction (see arrow 18).

A clamping point 19 and a cutting point 20 are attached to each thread guide 11. Elements 19 and 20 are activated in accordance with a predetermined patterning program, often when the appropriate thread 12 is, at the time, not required. When the thread 12 is cut off and tightly clamped, the thread guide 11 rotates further without laying off anything onto drum 1. In order to activate the thread 12 upon demand, a stationary holding arrangement 21 is employed. Upon opening of the clamping point 19, stationary holding arrangement 21 grasps the free thread end 22, whereupon this thread 12 is wound onto drum 1 from its thread guide 11.

In the illustrated embodiment the stationary holding arrangement 21 is shown as a suction jet 23. In place thereof, or in addition thereto, a stationary clamping arrangement 24 may be provided.

For the activation of the clamping point 19 and the cutting point 20, an activating arrangement 25 is provided which is formed from an air cylinder, an electromagnet or the like, which rotates together with the thread guide 11. It is more advantageous, however, to utilize a Maltese cross switching drive 26, whose Maltese cross 27 and its radial spokes 14 are rotatably mounted. A stationary switching arrangement 29 activatable by air cylinder 28 comprises a switching element 30 which is selectively moveable from the position indicated in phantom, to the fully drawn position and thus brought into interaction with the Maltese cross 27. During the pre-run past the radial spokes 14 on the switching arrangement 29, the Maltese cross 27 may be turned thereby during the first turn of 90°. The clamping position 19 is closed and the cutting point 20 is activated. During a second 90° rotation, the clamping position 19 is again opened so that the free thread end 22 can be grasped by holding arrangement 21.

Obviously, many modifications and variations of the present invention are possible in light of the above teachings. It is therefore to be understood that within the scope of the appended claims, the invention may be practiced otherwise than as specifically described.

What is claimed is:

1. Process of utilizing thread guides for producing, on axially oriented transport bands distributed circumferentially around a non-rotating drum, pattern warps made from differentiable thread from a rotatable creel, the process comprising the steps of:

pulling from the rotatable creel a plurality of differentiable threads by rotating the thread guides synchronously with the rotatable creel;

laying said threads about the transport bands on the non-rotating drum;

connecting those threads not needed at a particular time point to their thread guide by clamping and cutting the threads upstream of the drum; and holding stationary and unclamping from the thread guides, a free cut end of thread now needed.

2. Process in accordance with claim 1 wherein the pattern warps comprise at least two thread groups having intergroup differences in their threads, each group comprising at least two similar threads.

3. Pattern warps warping machine comprising:

a non-rotating drum;

a plurality of parallel axially oriented, transport bands distributed circumferentially around said drum; a rotating creel;

thread guides synchronously rotatable with said creel for pulling threads therefrom and laying some on the transport bands, said thread guides each having an orbiting clamping means for clamping thread at a clamping point, said clamping means including cutting means for cutting off threads between the clamping point and the drum; and stationary holding means on the machine for holding stationary, free thread ends of said cut off threads from the thread guides.

4. Warping machine in accordance with claim 3 wherein the clamping means comprises:

an orbiting Maltese cross operable to rotate and thereby clamp and unclamp thread at the clamping point; and a stationary switching arrangement having a switching member actuatable by said switching arrangement to bring said switching member into engagement with the Maltese cross to cause its rotation.

5. Warping machine in accordance with claim 3 wherein the cutting means has a cutting point that orbits with the clamping point, the cutting means and the clamping means being commonly activated.

6. Warping machine in accordance with claim 5 wherein the clamping means comprises:

an orbiting Maltese cross operable to rotate and thereby clamp and unclamp thread at the clamping point; and a stationary switching arrangement having a switching member actuatable by said switching arrangement to bring said switching member into engagement with the Maltese cross to cause its rotation.

7. Warping machine in accordance with claim 3 wherein the clamping means comprises:

an orbiting air cylinder for causing clamping and unclamping at the clamping point and rotating with said clamping means.

8. Warping machine in accordance with claim 3 comprising:

an orbiting electromagnet rotating with the clamping point for opening and closing said electromagnet.

9. Warp knitting machine in accordance with claim 3 wherein the stationary holding means comprises a suction jet.

10. Warping machine in accordance with claim 3 wherein the stationary holding means comprises:

a stationary clamping arrangement.

* * * * *